US009175462B2

(12) United States Patent
Berry

(10) Patent No.: US 9,175,462 B2
(45) **Date of Patent: *Nov. 3, 2015**

(54) SYSTEM FOR DELIVERING CHEMICALS TO A TOILET BOWL

(71) Applicant: Donald P. Berry, Debary, FL (US)

(72) Inventor: Donald P. Berry, Debary, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/917,555

(22) Filed: Jun. 13, 2013

(65) Prior Publication Data

US 2013/0305442 A1 Nov. 21, 2013

Related U.S. Application Data

(63) Continuation of application No. 13/360,540, filed on Jan. 27, 2012, now Pat. No. 8,484,769.

(51) Int. Cl.
*E03D 9/00* (2006.01)
*E03D 9/03* (2006.01)

(52) U.S. Cl.
CPC ..... *E03D 9/032* (2013.01); *E03D 9/033* (2013.01); *E03D 9/037* (2013.01)

(58) Field of Classification Search
USPC ..... 4/222, 223, 224, 225.1, 227.1–227.7
See application file for complete search history.

(56) References Cited

U.S. PATENT DOCUMENTS

| | | | | |
|---|---|---|---|---|
| 1,079,848 | A | 11/1913 | Ellingwood | |
| 1,372,328 | A | 3/1921 | Adams | |
| 2,045,473 | A | 6/1936 | Keillor | |
| 2,065,181 | A | 12/1936 | French | |
| 3,882,864 | A * | 5/1975 | Montgomery | 604/151 |
| 4,312,082 | A * | 1/1982 | Murphy et al. | 4/225.1 |
| 6,993,795 | B2 * | 2/2006 | Prineppi | 4/227.1 |
| 2002/0116752 | A1 * | 8/2002 | Nguyen | 4/225.1 |

* cited by examiner

*Primary Examiner* — Lauren Crane
*Assistant Examiner* — Erin Deery
(74) *Attorney, Agent, or Firm* — Michael L. Leetzow, P.A.

(57) ABSTRACT

A chemical system is provided for adding a small amount of chemicals to a toilet bowl at the end of the flush cycle. The system has several chambers and a mechanism to add water to the system to force chemicals out and into the overflow tube of the toilet.

14 Claims, 7 Drawing Sheets

SYSTEM FOR DELIVERING CHEMICALS TO A TOILET BOWL

This application is a continuation application of and claims priority to U.S. patent application Ser. No. 13/360,540, filed on Jan. 27, 2012, which is hereby incorporated by reference in its entirety.

BACKGROUND OF THE INVENTION

Field of the Invention

The present invention is directed to a system for delivering chemicals to a toilet bowl and, in particular, in delivering the chemicals at the end of the flush cycle so that the chemicals remain in the toilet bowl.

Keeping a toilet bowl clean and free from unwanted growth and odors is a difficult task. Users can attempt to the keep the bowl clean by adding chemicals directly or by constantly brushing the toilet bowl. Companies have provided systems that allow for the addition of chemicals upon flushing, either by hanging a solid under the edge of the toilet bowl or by adding chemicals to the water holding tank associated with the toilet bowl. However, the majority of these chemicals are typically flushed away as the water goes through the toilet bowl to wash away the waste deposited in the toilet bowl. As a result, the chemicals are being sent through the toilet to the sewer or septic tank and the consumer is paying for chemicals that do not provide much of a benefit in keeping the toilet bowl clean.

SUMMARY OF THE INVENTION

According to one aspect of the present invention, a system is provided for delivering a quantity of chemicals into a toilet bowl that includes a first chamber holding the chemicals to be delivered into the toilet bowl, the first chamber having an inlet and and an outlet, a second chamber in fluid communication with the first chamber, the second chamber having an outlet portion and an inlet portion, the outlet portion being in fluid communication with the inlet of the first chamber, a third chamber having an outlet in fluid communication with the inlet portion of the second chamber, the third chamber filling with fluid during a refilling of a tank associated with the toilet bowl, the fluid filling the third chamber and causing fluid in the second chamber to force chemicals out of the third chamber at the end of the filling of the tank, the chemicals flowing into the toilet bowl at the end of the filling of the tank.

In yet another aspect, a system for delivering a quantity of chemicals into a toilet bowl is provided that includes a main body comprises at least two chambers, a chemical chamber for holding the chemicals and a fluid chamber that empties and fills with fluid in a tank associated with the toilet bowl, and a container movable within the fluid chamber of the main body, the container movable from a first position to a second position during operation of the toilet, wherein fluid from the movable container causes chemicals from the chemical chamber to flow into the toilet bowl.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
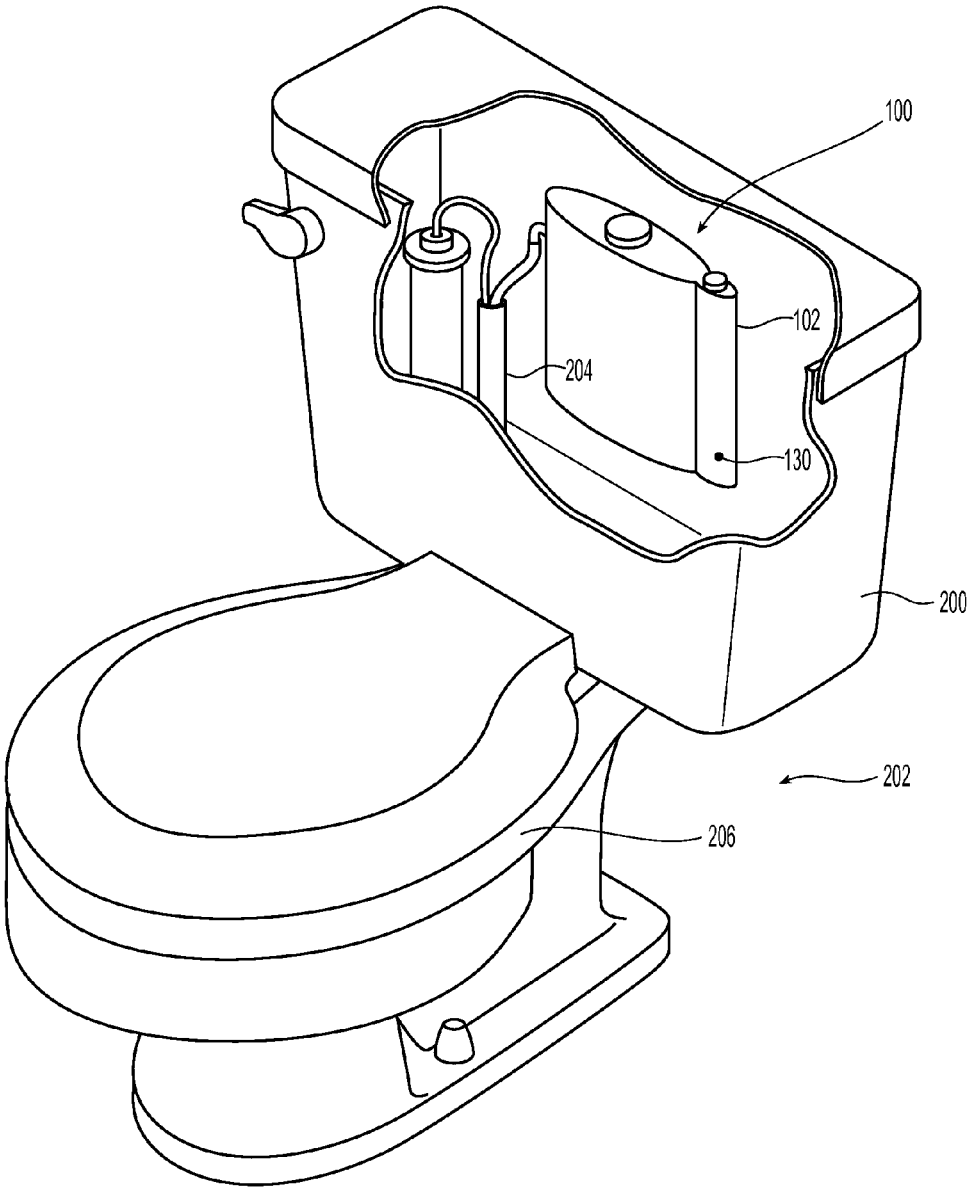
FIG. 1 is a perspective view with a partial cut away showing one embodiment of a system according to the present invention.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
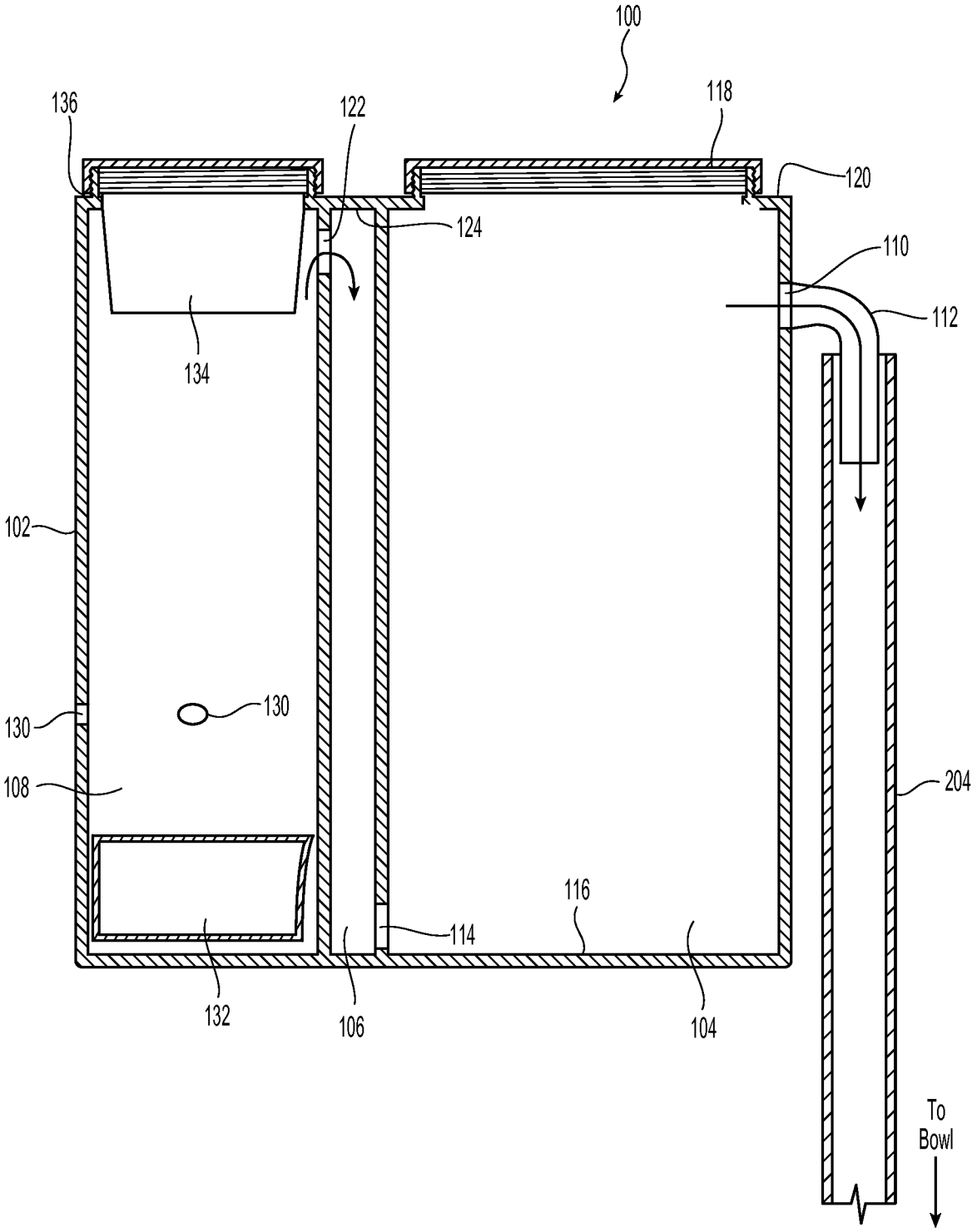
FIG. 2 is a cross sectional view of the system of FIG. 1 with a container in first position.

Referring to FIGS. 1 and 2, one embodiment of a chemical system 100 is illustrated. The chemical system 100 preferably is an unitary body 102 that has three chambers 104,106,108. As illustrated in FIG. 1, the chemical system 100 is preferably secured in the water tank 200 of toilet 202. As discussed in more detail below, the toilet 202 also has an overflow tube 204 that is fluid communication with toilet bowl 206 and the chemical system 100 is in fluid communication with the overflow tube 204. The manner and method of securing the chemical system is not critical, but it could have a tab to hang on the edge of the tank or be secured with an adhesive.

Figure 3:
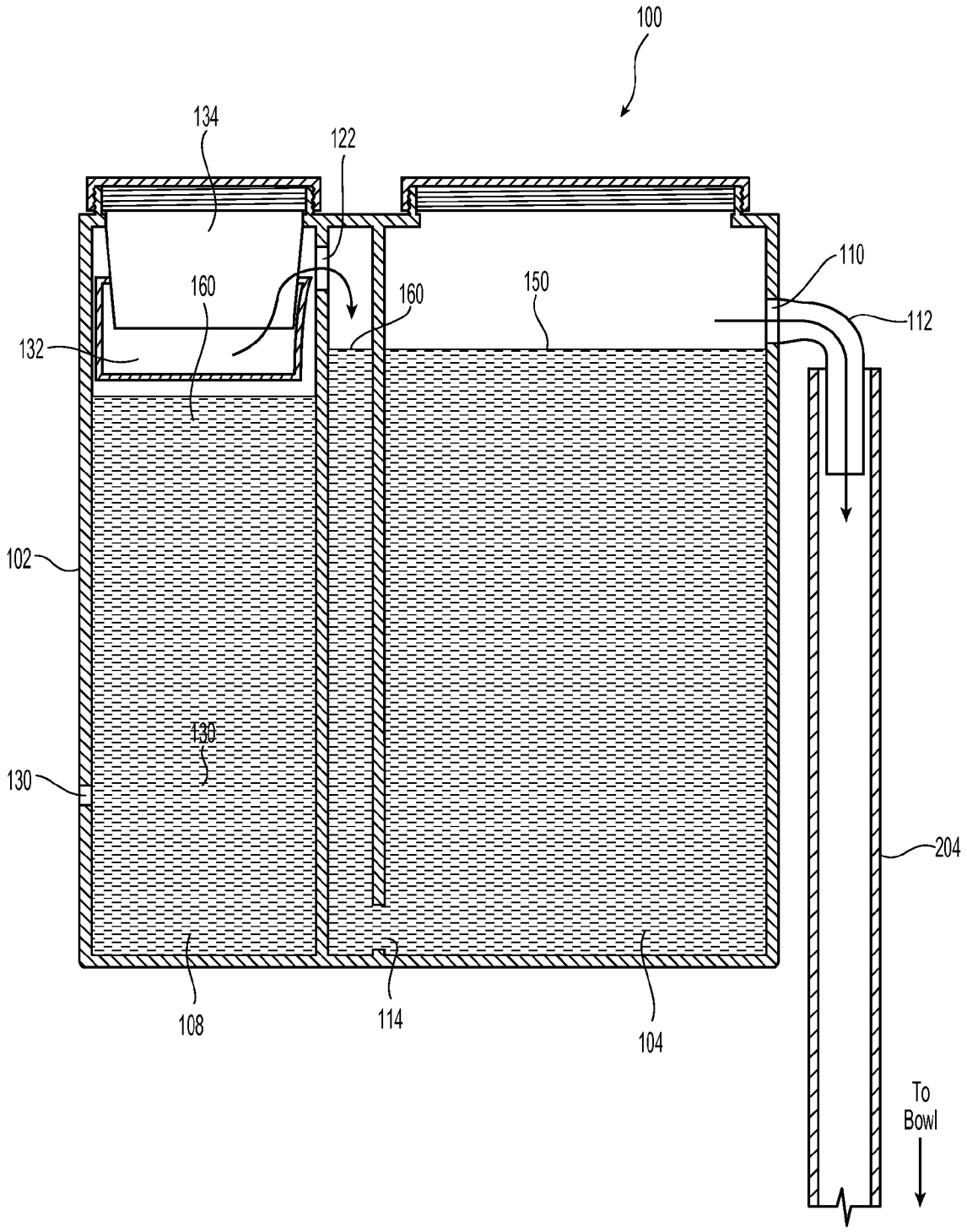
FIG. 3 is a cross section view of the system of FIG. 2 with the container in a second position.

As more visible in FIG. 2, the chemical system 100 has a first chamber 104 that holds the chemicals 150 (see FIG. 3) that are to be used in the toilet bowl 206. The first chamber 104 is preferably the larger chamber of the three chambers for reasons that will become apparent. The first chamber 104 has an outlet 110 with a conduit 112 that is at least preferably inserted into the overflow tube 204. As illustrated in FIG. 2, the conduit 112 is a tubular element that is preferably rigid, but may also be flexible.

The first chamber 104 also has an inlet 114, which is preferably disposed near the bottom 116 of the first chamber 104. The first chamber also has an closable opening 118 at the top 120 so that more chemicals can easily be added to the first chamber 102. The chemicals can either be a liquid or a dissolvable solid to prevent lime scale buildup, clean the toilet and leave it smelling fresh.

A second chamber 106 is in fluid communication with the first chamber 104 through the inlet 114. The second chamber 106 has as its outlet the inlet 114 of the first chamber 104. The second chamber 106 also has an inlet 122 near the top 124 of the second chamber 106. As will become apparent, the inlet 122 needs to be higher than the outlet 110 of the first chamber to ensure that fluid flows through the chemical system 100 correctly. The second chamber 106 is considerably smaller than the first chamber 104 and acts as a conduit for fluid 160 (water in this case) to be moved through the chemical system 100.

Second chamber 106 is in fluid communication with third chamber 108 through the inlet 122 of second chamber 106. The third chamber 106 has openings 130 to allow fluid/water to enter the third chamber 108 during the refilling of the water tank 200. The number and location of the openings 130 is not critical, but should allow for the third chamber 106 to be filling at the same rate as the water tank 202. That is, the openings 130 should not be so small or few in number to impede the flow of the water into the third chamber 108. When the water starts to fill the third chamber 108, the container 132 partially fills with the liquid but floats to the top of the third chamber 108, where an insert 134 at the top portion of the third chamber 108 is configured to fit within the container 132. The insert 134 forces water out of the container 132 and into the inlet 122 of the second chamber 106. See FIG. 3. The amount of water that passes through the inlet 122 can be altered by the position of the insert 134 and the position of the chemical system in the water tank 200. Since the outlet 110 is positioned lower than the inlet 122, the addition of water to second chamber 106 forces water into the first chamber and the chemicals out of the outlet 110 as illustrated by the arrows in FIG. 3. Since the position of the chemical system is such that the container 132 reaches the insert 134 at the end of the filling of the water tank 200, the chemicals are introduced into the overflow tube 204 at the end of the fill cycle of the toilet 202. In this way, only a small portion of chemicals need to be added to the water since all (or nearly all) of the chemicals added to the toilet bowl 206 will remain in the bowl as it fills up rather than during the flush cycle.

Figure 4:
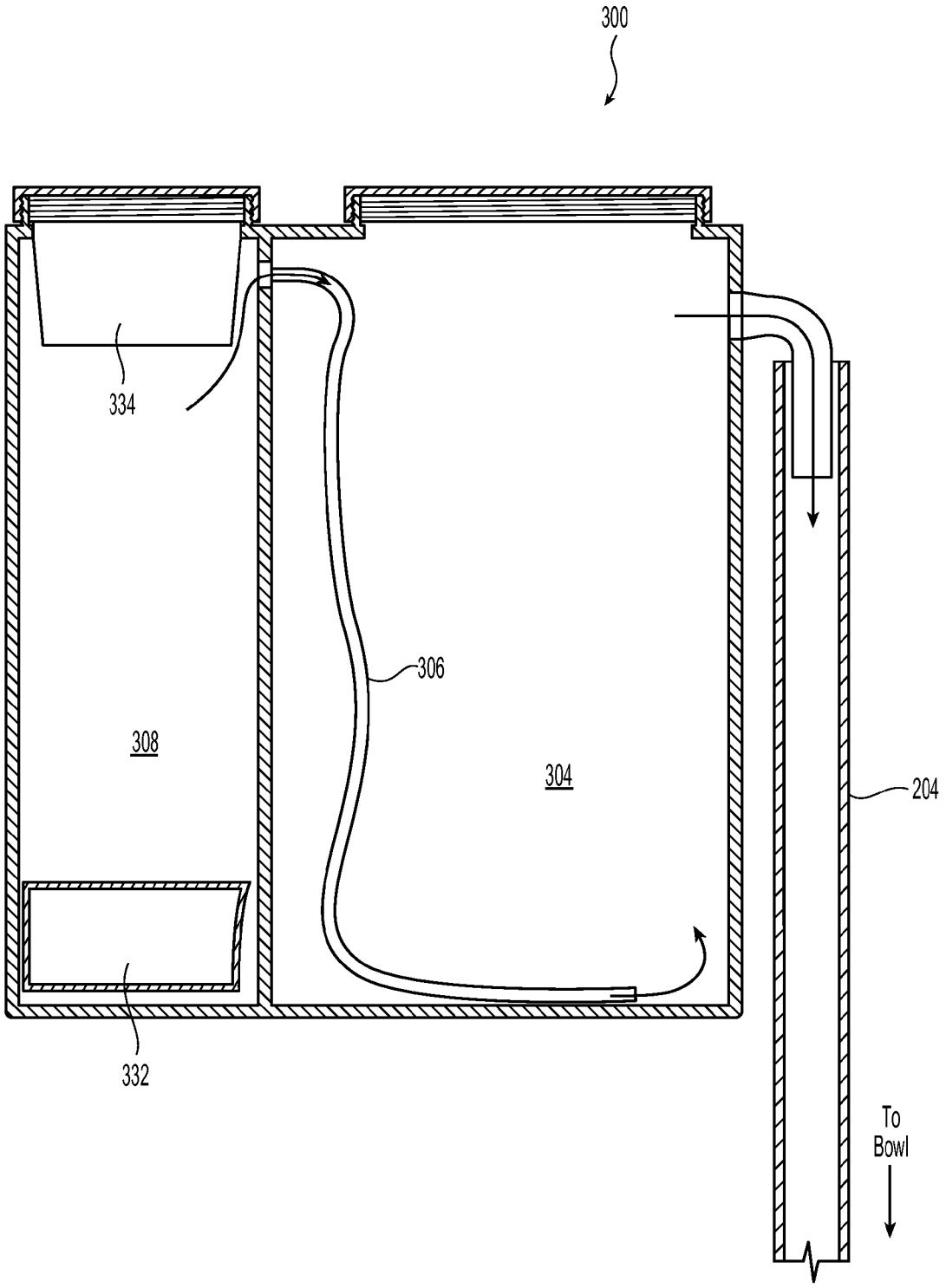
FIG. 4 is a cross-sectional view of another embodiment of a system according to the present invention; p

An alternative embodiment of a chemical system 300 is illustrated in FIG. 4. In this embodiment, the chemical system 300 operates in the same manner as chemical system 100, but has a tubular element 306 that functions as the second chamber of the prior embodiment. The chemical system 300 has a first chamber 304 and a third chamber 308. The functions of the openings 330 and the container 332 with the insert 334 is as described above.

Figure 5:
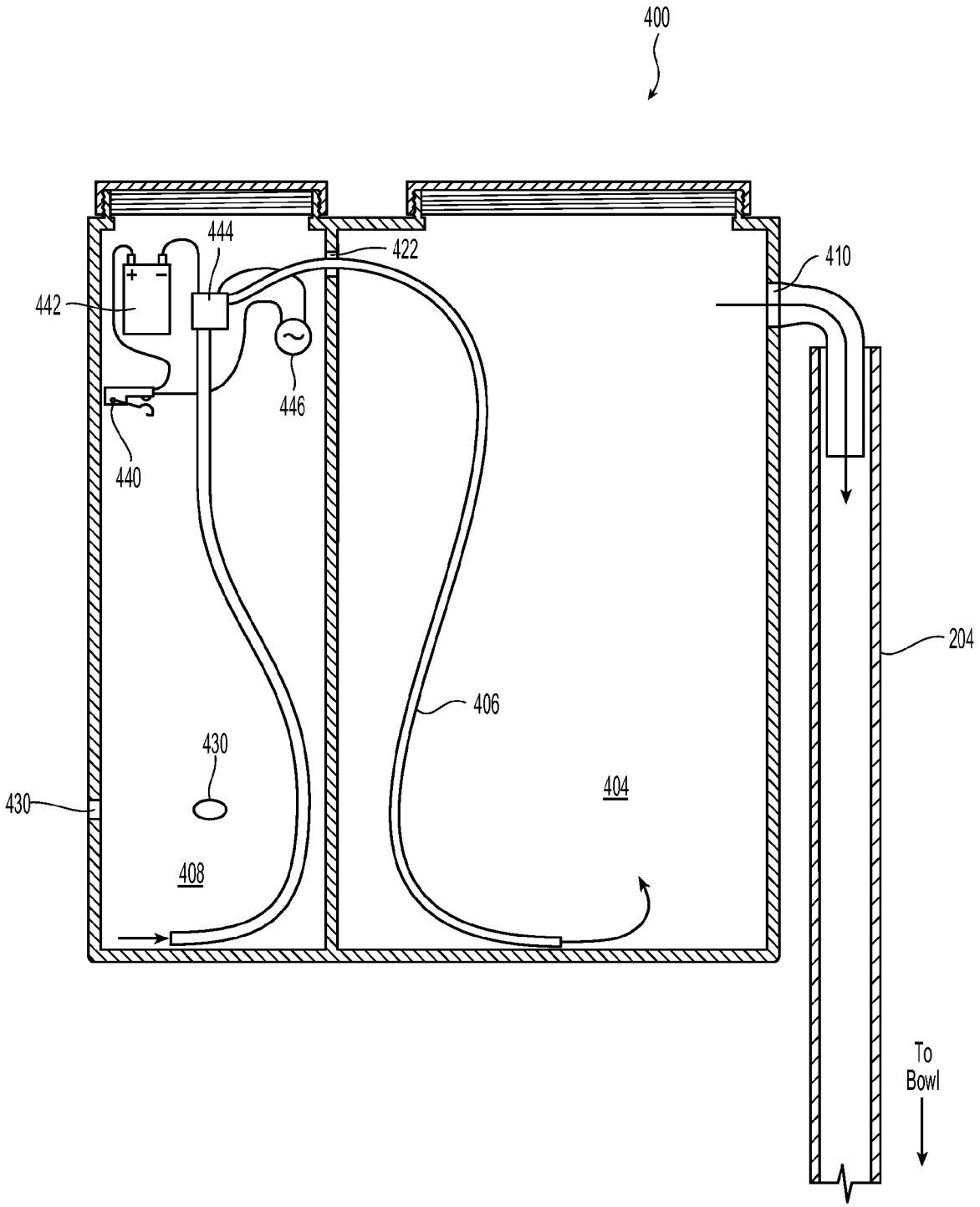
FIG. 5 is a cross-sectional view of another embodiment of a system according to the present invention.

Another embodiment of a chemical system 400 is illustrated in FIG. 5. In this embodiment, the container/insert of the system has been replaced with a pump mechanism. Chemical system 400 has a first chamber 404 in fluid communication with overflow tube 204 and a third chamber 408 with openings 430 to allow water to enter the third chamber. The pump mechanism has a fluid sensing switch 440, a battery 442 connected to the fluid sensing switch 440 and a pump 444. The pump 444 is also connected to an adjustable switch 446 to regulate the amount of liquid that the pump 444 injects into the tubular element 406 and into the third chamber 404. The owner can adjust the adjustable switch 446 to add more or less chemicals to the toilet 202. As the water enters the third chamber 408 and makes contact with the water sensing switch 440 at the end of the filling cycle, a signal is sent to the pump to draw water from the third chamber and pump it into the first chamber 404 with the chemicals. As a result of the water being added to the third chamber 408, the chemicals exit the first chamber 404 at the end of the filling of the third chamber 408.

In chemical system 400, the inlet 422 is positioned higher than the outlet 410 so that liquid in the third does not flow back into the third chamber 408. It is also possible to seal the inlet 422 around the tubular element 406 to prevent any accidental movement of the liquids between chambers. The various parts of the pump mechanism could also be in a separate container to protect them from exposure to water—except the water sensing switch which must be exposed to the water.

Figure 6:
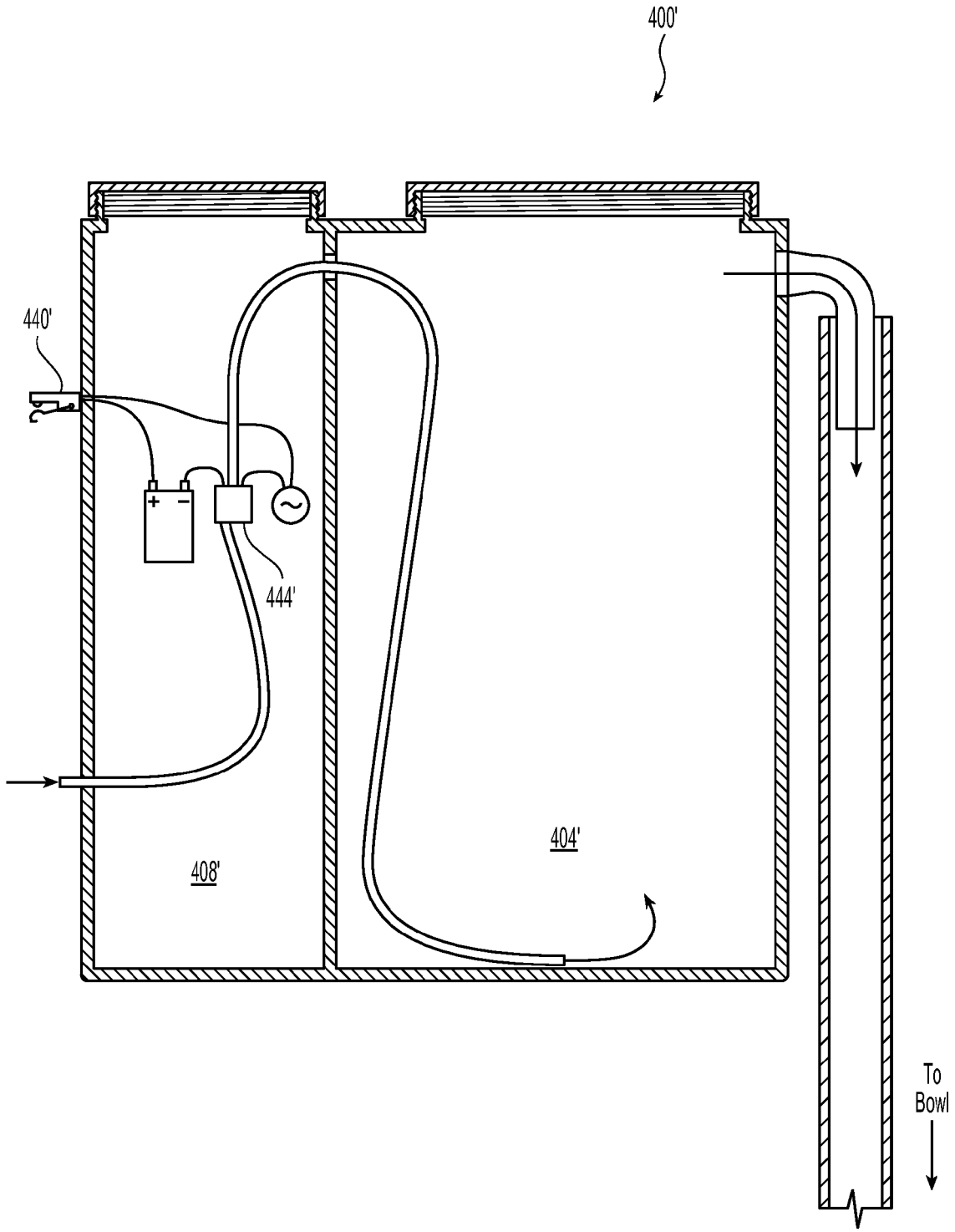
FIG. 6 is a cross sectional view showing another embodiment of a system according to the present invention.

FIG. 6 illustrates a different embodiment of a chemical system 400'. In this embodiment, the pump 444' receives the water from outside the system 400' and in the water tank 200. In this way, the remaining parts of the pump system do not need to be exposed to the water. The water is pumped by pump 444' directly through the third chamber 408' to the first chamber 404'.

Figure 7:
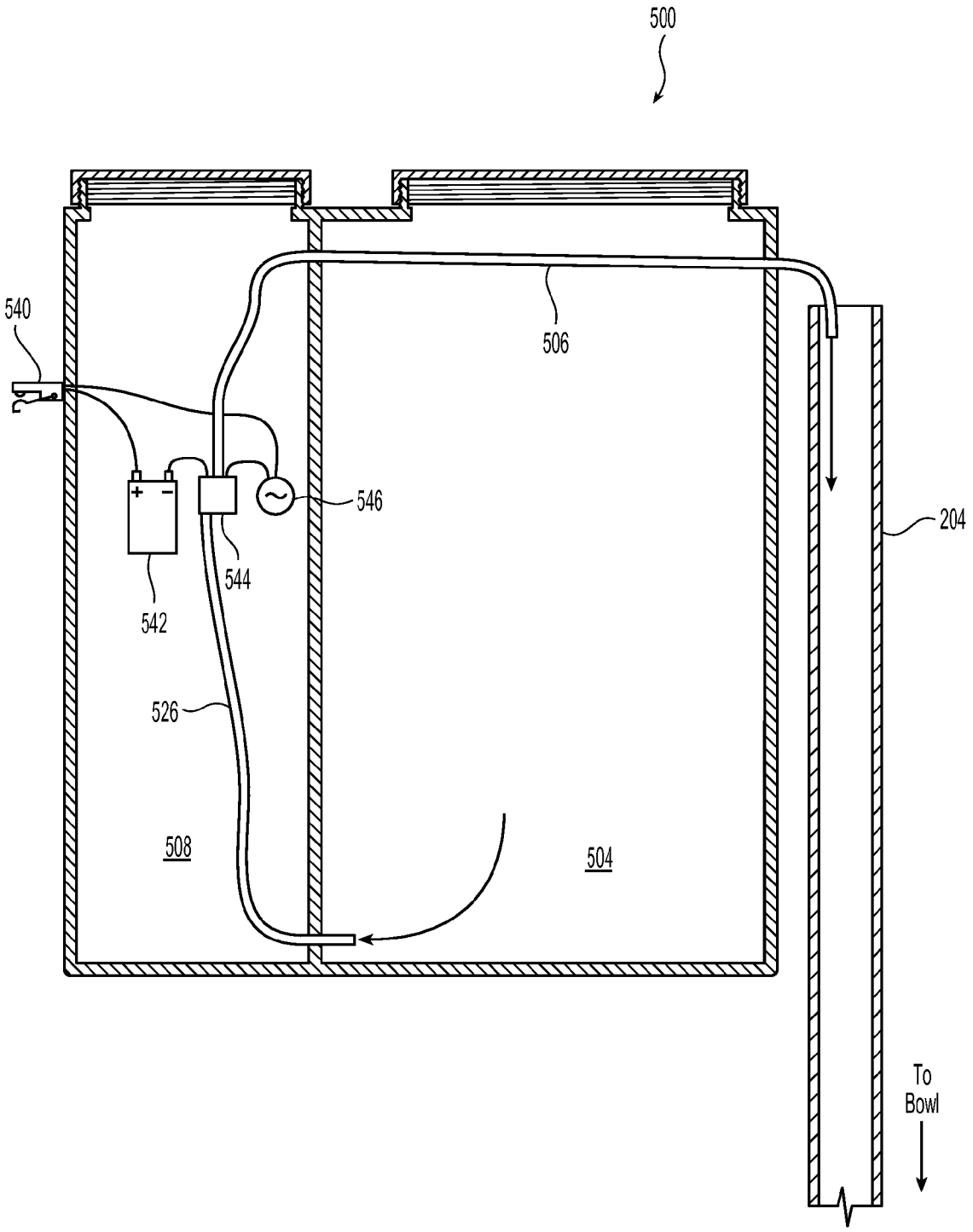
FIG. 7 is a cross sectional view showing another embodiment of a system according to the present invention.

FIG. 7 illustrates another embodiment of a chemical system 500. Chemical system 500 has a first chamber 504 and a third chamber 508. The first chamber 504 is completely sealed with respect to the third chamber 508. Chemicals reside in the first chamber 504 as described above. However, the third chamber 508 remains dry and does not have any contact with the water from the water tank 200. Instead, the battery 542, pump 544, and adjustable switch 546 are placed in the dry third chamber 508. When the fluid sensing switch 540 senses that the water is about at its height in the tank, the pump 544 pulls through the flexible member 526 a small amount of the chemical from the first chamber 508. The pump 544 pumps the chemical through the tubular element 506 into the overflow tube 204. While the end of tubular element 506 is placed in the overflow tube, another outlet configuration could be realized and still be within the scope of the present invention. Additionally, tubular element 506 is illustrated as passing through the first chamber 504, but it could be routed in another manner as well.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

I claim:

1. A system for delivering a quantity of chemicals into a toilet bowl comprising:
   - a chemical container having chemicals to be delivered to the toilet bowl;
   - an outlet attached to and in fluid communication with the chemical container and an overflow tube, the overflow tube in fluid communication with the toilet bowl;
   - an electric pump having a pump inlet and a pump outlet; and
   - a chamber in which the electric pump is disposed. the pump inlet external to the chamber, and wherein the pump outlet disposed in the chemical container, the pump pumping fluid from the pump inlet to the outlet and into the chemical container to cause chemicals to flow into the toilet bowl through the overflow tube during the filling of the toilet bowl.

2. The system according to claim 1, wherein the electric pump has a fluid sensing switch in electrical communication therewith to sense the location of water filling a water tank associated with the toilet bowl.

3. The system according to claim 1, wherein the electric pump pumps water from a water tank associated with the toilet bowl into the chemical container.

4. The system according to claim 1, further comprising an adjustable switch, the adjustable switch in electrical communication with the electric pump, the adjustable switch regulating the amount of fluid pumped from the inlet to the outlet.

5. A system for delivering a quantity of chemicals into a toilet bowl comprising:

a chemical container having chemicals to be delivered to the toilet bowl;

a fluid sensing switch;

an electric pump having a pump inlet and a pump outlet and being in electrical communication with the fluid sensing switch; and a chamber in which the electric pump is disposed, the pump outlet in fluid communication with the chemical container, the electric pump pumping fluid from the pump inlet disposed within the chamber to the pump outlet and into the chemical container to cause chemicals to flow into the toilet bowl through the overflow tube during the filling of the toilet bowl upon receiving a signal from the fluid sensing switch wherein the electric pump is in fluid communication with an intermediate container, the intermediate container is in fluid communication with the chemical container and the fluid passes through the intermediate container.

6. The system according to claim 5, wherein the intermediate container is a tube.

7. The system according to claim 5, wherein the electric pump pumps water from a water tank associated with the toilet bowl into the chemical container.

8. The system according to claim 5, further comprising an adjustable switch, the adjustable switch in electrical communication with the electric pump, the adjustable switch regulating the amount of fluid pumped from the inlet to the outlet.

9. The system according to claim 5, further comprising a fluid sensing switch in electrical communication with the electric pump.

10. The system according to claim 9, wherein the fluid sensing switch is disposed external to the chamber.

11. A system for delivering a quantity of chemicals into a toilet bowl comprising:

a chemical container having chemicals to be delivered to the toilet bowl;

a fluid sensing switch;

an electric pump having a pump inlet and a pump outlet and being in electrical communication with the fluid sensing switch; and a chamber configured to contain the electric pump, the pump inlet and the fluid sensing switch both disposed external to the chamber, wherein the pump outlet is in fluid communication with the chemical container, the electric pump pumping fluid from the pump inlet to the pump outlet and into the chemical container to cause chemicals to flow into the toilet bowl through the overflow tube during every filling of the toilet bowl upon receiving a signal from the fluid sensing switch.

12. The system according to claim 11, wherein the electric pump pumps water from a water tank associated with the toilet bowl into the chemical container.

13. The system according to claim 11, further comprising an adjustable switch, the adjustable switch in electrical communication with the electric pump, the adjustable switch regulating the amount of fluid pumped from the inlet to the outlet.

14. A system for delivering a quantity of chemicals into a toilet bowl comprising:

a chemical container having chemicals to be delivered to the toilet bowl;

an electric pump having a pump inlet and a pump outlet and being in electrical communication with the fluid sensing switch;

a chamber in which the electric pump is disposed, the pump outlet in fluid communication with the chemical container, the electric pump pumping fluid from the pump inlet disposed within the chamber to the pump outlet and into the chemical container to cause chemicals to flow into the toilet bowl through the overflow tube during the filling of the toilet bowl upon receiving a signal from the fluid sensing switch; and a fluid sensing switch in electrical communication with the electric pump, the fluid sensing switch being disposed external to the chamber.

* * * * *